United States Patent [19]

Kumano

[11] 4,351,222

[45] Sep. 28, 1982

[54] KEYBOARD MUSICAL INSTRUMENT WITH CASING COMPRISING TWO HALVES

[75] Inventor: Shinji Kumano, Shizuoka, Japan

[73] Assignee: Nippon Gakki Seizo Kabushiki Kaisha, Japan

[21] Appl. No.: 272,029

[22] Filed: Jun. 9, 1981

[30] Foreign Application Priority Data

| | | | |
|---|---|---|---|
| Jul. 4, 1980 | [JP] | Japan | 55-94135[U] |
| Jul. 4, 1980 | [JP] | Japan | 55-94136[U] |
| Jul. 4, 1980 | [JP] | Japan | 55-94137[U] |
| Jul. 4, 1980 | [JP] | Japan | 55-94138[U] |
| Jul. 4, 1980 | [JP] | Japan | 55-94139[U] |

[51] Int. Cl.[3] ..... G10C 3/12; G10C 3/04

[52] U.S. Cl. ..... 84/423 R; 84/177

[58] Field of Search ..... 84/177, 351, 352, 423, 84/434, 435, DIG. 7, 431-432; 235/145 R

[56] References Cited

U.S. PATENT DOCUMENTS 3,740,448 6/1973 Olszowka et al. ..... 84/423 X

*Primary Examiner*—L. T. Hix

*Assistant Examiner*—Thomas H. Tarcza

*Attorney, Agent, or Firm*—Kane, Dalsimer, Kane, Sullivan and Kurucz

[57] ABSTRACT

A portable electronic keyboard musical instrument comprises a casing comprising a pair of plastic-molded upper and lower shells coupled together. A plurality of keys are mounted on the upper shell in juxtaposed relation. The upper shell includes an integral fulcrum portion formed internally thereof and pivotally supporting each key, an integral stop means for limiting the downward and upward movements of the keys, an integral guide means for guiding the downward and upward movements of the keys, and an integral mounting portion for supporting a key switch structure. The stop means, the guide means and the mounting portion are disposed in underlying relation to the juxtaposed keys.

12 Claims, 5 Drawing Figures

KEYBOARD MUSICAL INSTRUMENT WITH CASING COMPRISING TWO HALVES

BACKGROUND OF THE INVENTION

1. Field of the Invention

This invention relates to a keyboard musical instrument having a casing comprising two halves, more particularly to a portable electronic keyboard instrument with the casing made of plastics.

2. Prior Art

Conventional musical instrument of the type under consideration employs a casing comprising molded upper and lower half shells connected together, the shells being made of a suitable synthetic resin. The lower shell has multiple integral sections for mounting associated keys and other components. In order to facilitate the removal of the lower shell from molds, recesses are formed in the outer surface of the lower shell at regions where the integral mounting sections are provided. This detracts much from the appearance of the casing. One method of overcoming this difficulty has been to provide molds designed to form a lower shell having no recess. This procedure has been found not satisfactory, however, in that it increases the manufacturing cost of the lower shell because of added molding material. Another alternative has been to provide a separate cover member designed to be attached to the outer surface of the lower shell to conceal the recesses from view. However, this approach also has been found not satisfactory in that it increases the manufacturing cost of the casing on account of the addition of such a separate cover member.

Conventionally, the lower shell has a battery receiving portion at the rear portion thereof, and therefore the horizontal depth of the casing is increased. Further, the lower shell has an integral stop means for limiting the upward movement of the keys. With this construction, the keys could not easily be mounted on and removed from the lower shell.

There is known another keyboard structure in which each key has a downwardly extending rear end portion which is loosely received in an opening formed through a chassis. A transverse groove is formed in the rear end face of the key and is engaged with the edge of the opening about which the key is pivotally movable. A separate retaining member is secured to the chassis and extends into the opening so that the end of the retaining member is disposed in closely spaced relation to the rear end portion of the key to thereby prevent the transverse groove from becoming disengaged from the opening edge during the operation of the key. This keyboard structure has been found disadvantageous in that it is rather difficult to mount the retaining member on the chassis since the retaining member must be attached to the chassis after the keys are mounted on the chassis. And besides, the separate retaining member is required only for the purpose of retaining the key in position on the chassis. Another keyboard structure is also known in which each key has at its rear end a transverse groove which engages the upper edge of an opening formed through an upwardly extending portion of a chassis. The key has a projection extending downwardly from its rear end, the projection being disposed in closely spaced, opposed relation to the lower edge of the opening so as to prevent the key from becoming disengaged from the opening during the operation of the key. This known keyboard structure has also been found disadvantageous in that the key can not easily be mounted on the chassis because of the presence of the projection.

One known molded key for a keyboard structure for an electronic musical instrument, such as an electronic organ, has an integral L-shaped retaining portion having a first leg extending downwardly from the key body and a second leg extending generally perpendicularly from the first leg at its lower end. The second leg is engageable with an associated chassis to limit the upward movement of the key. The outer surfaces of the first and second legs are disposed in coplanar relation to each other. Also, the inner surfaces of the first and second legs are disposed in coplanar relation. One problem of such a key is that a molding machine for forming the key is complicated in construction because of such an undercut construction. As a result, the key could not be manufactured at low costs.

The prior art keyboards employ a plurality of resilient members operatively associated with juxtaposed keys, respectively, for urging the same into their inoperative or raised position. The mounting of the plurality of resilient members on the keyboard required much time and labor. Further, it is quite difficult to mount the individual resilient members in such a manner that they apply uniform biasing forces to the respective keys. As a result, the touch of the keys is not uniform. Further, during the operation of the keys, stress is directly applied through the respective resilient members to a mounting portion of the frame which supports the resilient members. Therefore, the mounting portion must have a sufficient strength to withstand the stress exerted thereon. As a result, added material was required to increase the strength of the frame or chassis.

SUMMARY OF THE INVENTION

It is therefore a general object of this invention to provide a keyboard musical instrument which overcomes the above-mentioned deficiencies of the prior art.

According to the present invention, there is provided a keyboard musical instrument which comprises a casing comprising a pair of molded upper and lower shells coupled together; a plurality of keys mounted on the upper shell in juxtaposed relation; and means mounted on the upper shell for normally urging the keys into their raised position; the upper shell including an integral fulcrum portion formed internally thereof and supporting each key for pivotal movement thereabout between its raised and depressed positions, an integral stop means for limiting the downward and upward movements of the keys, an integral guide means for guiding the downward and upward movements of each key to prevent the lateral movement thereof, and an integral mounting portion for supporting switch means, all of the stop means, the guide means and the mounting portion being disposed in underlying relation to the juxtaposed keys.

Other advantages, features and additional objects of the present invention will become manifest to those versed in the art upon making reference to the detailed description and the accompanying sheets of drawings in which a preferred embodiment incorporating the principles of the present invention is shown by way of illustrative example.

DETAILED DESCRIPTION OF THE PREFERRED EMBODIMENT

Figure 1:
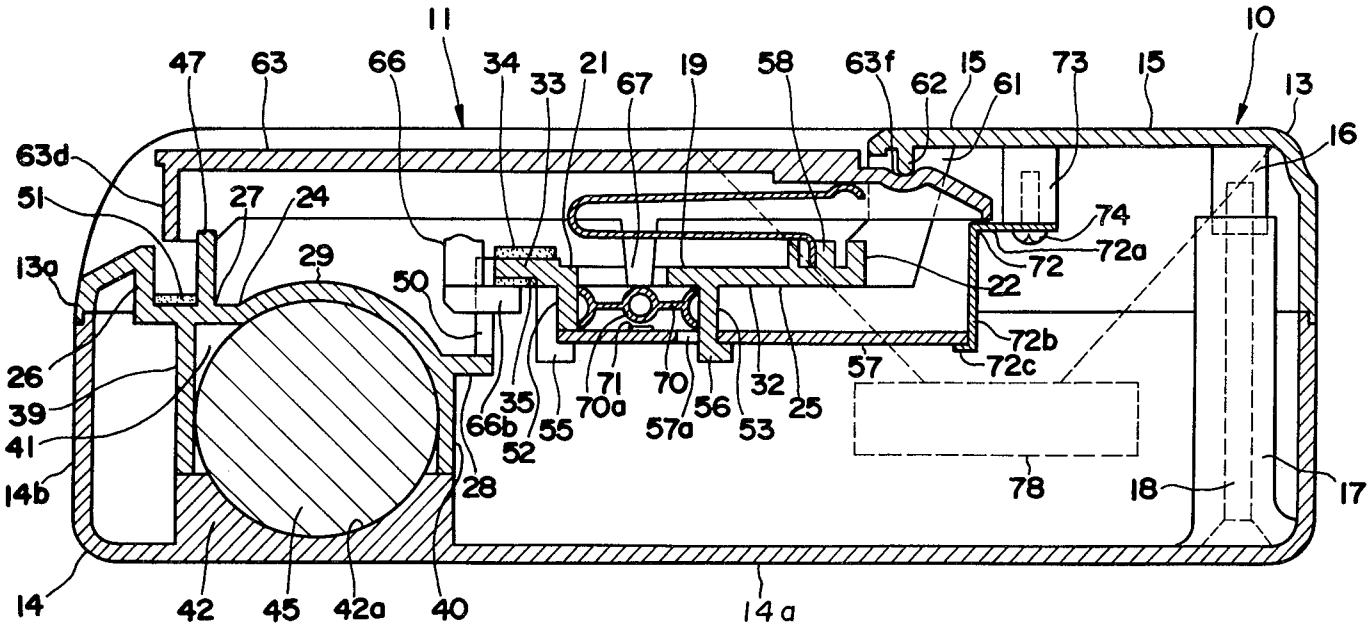
FIGS. 1 and 2 show cross-sectional views through a portable electronic organ incorporating a keyboard structure constructed in accordance with the present invention.
Figure 2:
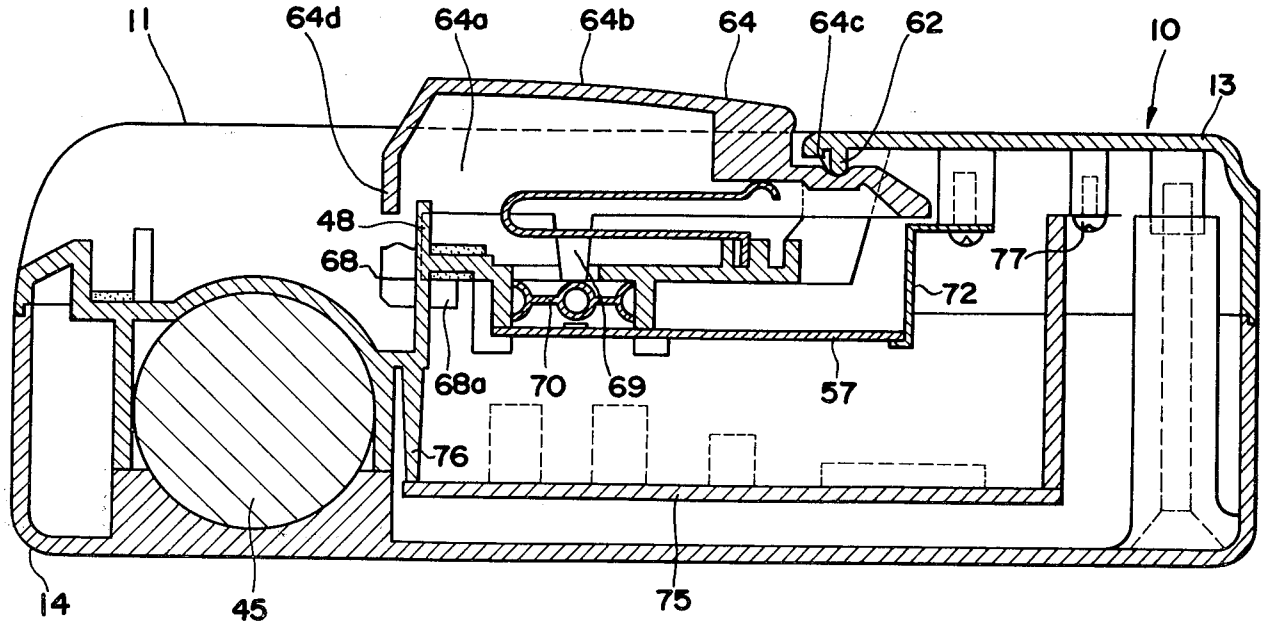

FIGS. 1 and 2 show a portable electronic organ 10 having a keyboard structure 11. The organ 10 comprises a casing which comprises a pair of upper and lower halves 13 and 14 coupled together to provide a generally box-like configuration. Each of the half shells is of a single or integrally molded construction and made of plastics or other suitable synthetic resin. The lower shell or base 14 is in the form of a box having an open top and a rectangular bottom wall 14*a*. The upper shell 13 of a rectangular configuration has a top wall 15 disposed in parallel relation to the bottom wall 14*a* of the lower shell 14. The upper and lower shells 13 and 14 are jointed together with their peripheral edges being mated together. A plurality of upper bosses 16 are formed integrally on the underside of the top wall 15 of the upper shell 13 while a corresponding number of lower bosses 17 of greater length are formed integrally on the bottom wall 14*a* of the lower shell 14, the upper bosses 16 being disposed in alignment with the lower bosses 17, respectively, and having their lower ends received in the upper ends of the respective lower bosses. The upper and lower shells 13 and 14 are connected together by screw bolts 18 each passing through the lower boss into the upper boss.

Figure 3:
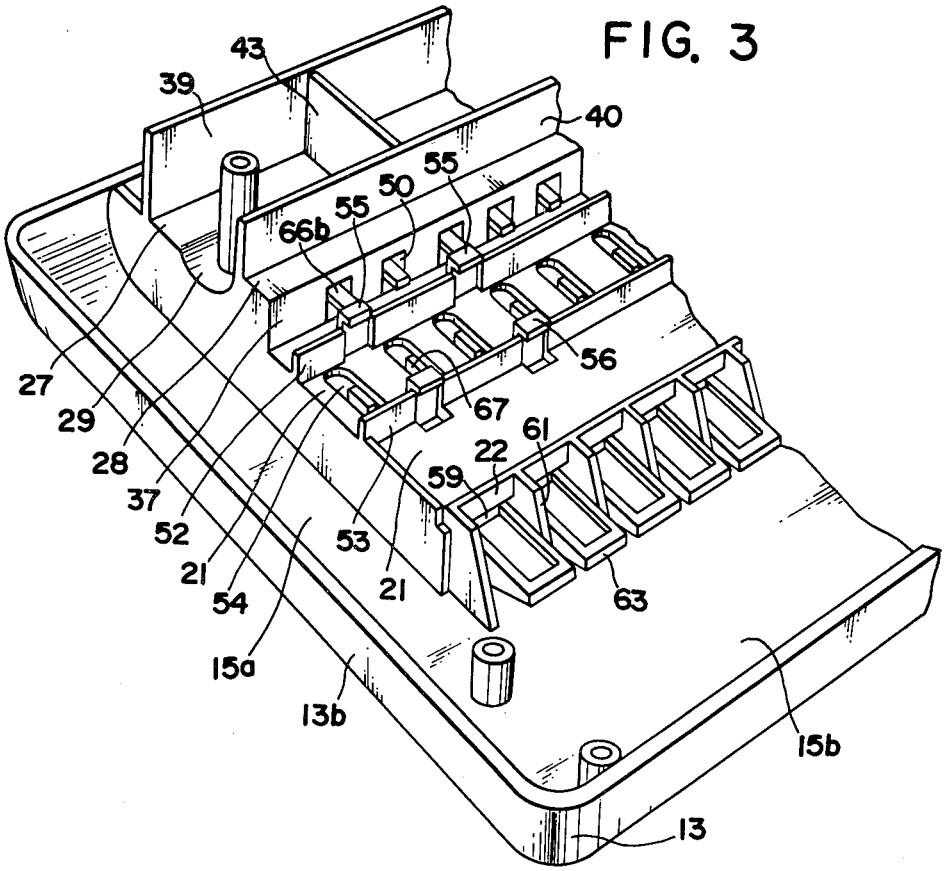
FIG. 3 is a fragmentary perspective view of an upper shell of a keyboard casing as shown upside down.

The upper shell 13 has a centrally located recess 19 for receiving a row of keys therein, as will be hereinafter more fully described. The recess 19 has a rectangular shape when viewed in a direction perpendicular to the top wall 15, the recess 19 opening to the front wall 13*a* of the upper shell 13. The top wall 15 has a U-shaped configuration having a pair of side portions 15*a* and 15*a* and a rear portion 15*b* interconnecting the side portions at their rear ends, as best shown in FIG. 3 showing the upper shell 13 upside down. The recess 19 is defined by a pair of spaced apart side walls 20 and 20 extending parallel to the side walls 13*b* and 13*b* of the upper shell 13, a bottom wall 21 extending between the side walls 20 and 20 and a rear wall 22 extending between the side walls 20 and 20, and the rear wall 22 extending at right angles from the bottom wall 21.

As best shown in FIGS. 1 and 2, the bottom wall 21 of the recess 19 has a front portion 24 and a generally flat rear portion 25. The front end of the front portion 24 is formed into a generally downwardly-opening channel 26. The front portion 24 also has a first flat section 27 extending rearwardly from the channel-shaped front end portion 26 in parallel relation to the top wall 15, a second flat section 28 extending parallel to the top wall 15, and a semi-cylindrical or convex section 29 lying between the first and second flat sections 27, 28, the second flat section 28 being disposed downwardly of the first flat section 27. The rear portion 25 of the recess bottom comprises a flat plate 32 extending in parallel relation to the top wall 15, the flat plate 32 being slightly stepped at its front end to provide a raised section 33 which serves as a stop means for the keys, as will hereinafter more fully be described. A pair of strips 34, 35 of felt are secured to the opposite surfaces of the raised section 33 to dampen any noise generated during the operation of the keys as will be described later. The second flat section 28 and the raised section 33 are interconnected by a connecting section 37 extending perpendicular thereto.

A pair of parallel spaced plates 39 and 40 depend from the first and second flat sections 27 and 28 respectively, the depending plates 27 and 28 extending along the front portion 24 so that the depending plates 39, 40 define together with the front portion 24 a downwardly opening channel portion 41 which serves as a battery receiving portion. The convex section 29 and the depending plate 40 jointly provide a continuous inner peripheral surface of a semi-cylindrical shape. The lower ends of the depending plates 39, 40 are spaced equidistantly from the bottom wall 14*a* of the lower shell 14.

A thickened portion 42 is formed integrally on the upper surface of the bottom wall 14*a* of the lower shell 14 and extends along the front wall 14*b* of the lower shell 14, the thickened portion 42 having a depression 42*a* of a semicircular cross-section formed in and extending along the top surface thereof. The thickened portion 42 is disposed in registry with the channel portion 41 with the lower ends of the depending plates 39 and 40 held against the top surface of the thickened portion 42, the outer surfaces of the depending plates 39 and 40 lying in coplanar relation to the opposite side faces of the thickened portion 42, respectively. The channel portion 41 has a pair of end walls 43 and 43 (FIG. 3). Thus, the channel portion 41, the thickened portion 42 and the end walls 43, 43 jointly provide a chamber in which batteries 45 are contained. The batteries 45 are seated on the complementally shaped depression 42*a* and also mated with the complementally shaped inner peripheral surface defined by the convex section 29 and the depending plate 40.

A plurality of first guide webs 47 of a rectangular shape are integrally formed on the upper surface of the first flat section 27, the guide webs 47 being spaced along the length of the channel portion 41. A plurality of second guide webs 48 extend upwardly from the connecting section 37 and are spaced along the length thereof. A plurality of apertures 50 of a rectangular shape are formed through the connecting section 37 and spaced along the length thereof, as best shown in FIG. 3. That portion of the first flat section 27 lying between the channel-shaped front end 26 and the first guide webs 47 serves as a stop means for limiting the downward movement of the keys, as will be described later. A strip 51 of felt is secured to said that portion.

A pair of spaced apart front and rear ribs 52 and 53 are formed integrally on the lower surface of the flat plate 32 and extend along the length thereof, as best shown in FIG. 3. A plurality of slots 54 are formed through that portion of the flat plate 32 lying between the ribs 52 and 53 and spaced along the length thereof. A plurality of front legs 55 of an L-shape depend from the flat plate 32 immediately adjacent to the raised section 33, the front legs 55 being also disposed immediately adjacent to the front rib 52. The front rib 52 is interrupted at regions where the front legs 55 are provided. A plurality of rear legs 56 of a L-shape depend from the rear rib 53. The front and rear legs 55 and 56 serve to support a printed circuit board 57, as will be described later.

An upwardly opening channel section 58 is formed on the upper surface of the flat plate 32 adjacent to the rear wall 22. The rear wall 22 has an opening 59 extending along the length thereof. A plurality of partition webs 61 are formed integrally on the underside of the rear portion 15*b* of the top wall 15 and connected at their lower ends to the rear wall 22, the partition webs 61 being spaced along the length of the opening 59 to divide the same into a plurality of sections. The partition webs 61 are disposed in parallel relation to the side walls 20 and 20 of the recess 19.

A plurality of ridges 62 are formed integrally on the underside of the rear portion 15*b* of the top wall 15 adjacent to its front edge, as shown in FIGS. 1 and 2, each ridge 62 extending between each adjacent partition webs 61. The ridges 62 are disposed in alignment with one another and serve as fulcrums for the respective keys, as will be later described.

Figure 4:
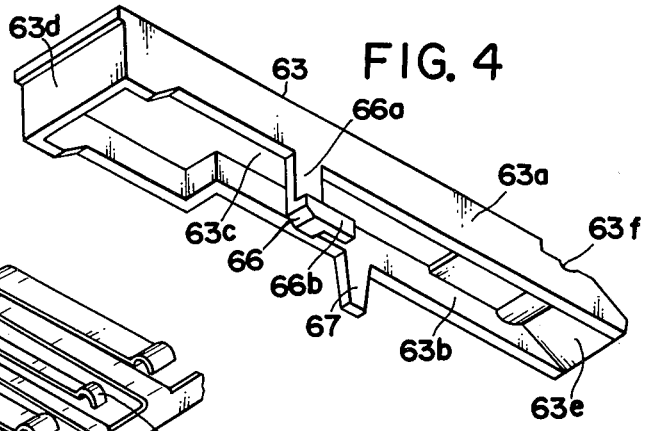
FIG. 4 is a perspective view of a white key used in the keyboard structure.

A plurality of white keys 63 and a plurality of black keys 64 are arranged in the recess 19 of the upper shell 13 in juxtaposed relation, these keys being single-molded from a suitable synthetic resin. As best shown in FIG. 4, each of the white keys 63 includes an elongated body of a generally channel shaped cross-section defined by a pair of arms 63*a* and 63*b* and a top wall 63*c* interconnecting the arms at their upper edges. The arm 63*b* is offset outwardly at its front portion so that the key body has a front end portion of a greater width. The offset portion and major portion of the arm 63*b* are disposed parallel to the arm 63*a*. The key body has a front end wall 63*d* disposed at right angles to the top wall 63*c* and a rear end wall 63*c* slanting downwardly in a direction away from the front end wall 63*d*. The top wall 63*c* is recessed adjacent to the slanted rear end wall 63*e* to provide a recessed portion. A transverse groove 63*f* of a U-shaped cross-section is formed in the recessed portion. The key body has a retaining portion 66 of an L-shape formed integrally on the lower edge of the arm 63*a*. The L-shaped retaining portion 66 has a first leg 66*a* extending downwardly perpendicular to the top wall 63*c* and a second leg 66*b* formed on the outer surface of the first leg 66*a* at its lower end and extending perpendicularly therefrom. A key switch actuator portion 67 is formed integrally on the lower edge of the arm 63*b* and extending downwardly therefrom, the actuator portion 67 being disposed rearwardly of the retaining portion 66.

Similarly, each of the black keys 64, which is substantially shorter than the white key 63, has an elongated body of a channel-shaped cross-section having a pair of arms 64*a* and 64*a* and a top wall 64*b* interconnecting the arms at their upper edges. The black key 64 has a transverse groove 64*c* of a U-shaped cross-section at its rear end of the top wall 64*b*. An L-shaped retaining portion 68 and an actuator portion 69 are formed integrally on the lower edges of the arms 64*a*, 64*a*, respectively, as described above for the white key 63. The retaining portion 68 is formed immediately adjacent to its front end wall 64*d*.

Each of the white keys 63 is arranged in the recess 19 of the upper shell 13 with the U-shaped groove 63*f* receiving the rounded end of the fulcrum ridge 62. The first guide web 47 is disposed in registry with the front end portion of the channel-shaped key 63 and has its upper end extended thereinto. The width of the first guide web 47 is slightly less than the width of the front end portion between the arm 63*a* and the offset portion of the arm 63*b*. The second leg 66*b* of the retaining portion 66 is extended through the aperture 50. The actuator portion 67 has its lower end received in the slot 54. The front end wall 63*d* of the key 63 is disposed in registry with the felt strip 51.

Similarly, each of the black keys is arranged in the recess 19 of the upper shell 13 with the U-shaped groove 64*c* receiving the rounded end of the fulcrum 62. The second guide web 48 is disposed in registry with the overlying channel-shaped key and has its upper end extended thereinto. The width of the second guide web 48 is slightly less than the width of the key between the arms 64*a* and 64*a*. The second leg 68*a* of the retaining portion 68 is extended through the aperture 50. The actuator portion 69 has its lower end received in the slot 54.

Electrically conductive rubber strips 70 extend between and are secured to the pair of ribs 52 and 53, the rubber strips being spaced along the length of the ribs 52 and 53 so that they are disposed in registry with the respective actuator portions 67 and 69 of the white and black keys 63 and 64. The cross-sectionally circular central portion 70*a* of each conductive rubber 70 is held in contact with the lower end of the actuator portion 67 and 69 of the respective key 63 and 64.

The printed circuit board 57 which carries a key switch circuit is arranged beneath the rear portion 25 of the recess bottom 21 in parallel relation to the top wall 15 of the upper shell 13. The board 57 extends along the length of the ribs 52 and 53 and has a plurality of apertures 57*a* spaced along the length thereof. The front end of the board is held against the front legs 55 with the lower margin held in engagement with the flange of the front leg 55, the upper margin being held in engagement with the lower end of the front rib 52 to prevent the upward movement of the board 57. Each of the rear legs 56 extends through and engages a respective one of the apertures 57*a* with the flange of the leg 56 held in engagement with the lower surface of the board adjacent to the aperture 57*a*. An L-shaped retaining member 72 of metal has a pair of first and second portions 72*a* and 72*b*, the lower end of the second portion 72*b* being directed away from the first portion 72*a* to provide a flange 72*c*. The retaining member 72 is fixedly secured to bosses 73 by screws 74 passing through the first portion 72*a* into the bosses 73, the bosses 73 being formed integrally on the underside of the rear portion 15*b* of the top wall 15. The rear end of the printed circuit board 57 is held against the second portion 72*b* of the retaining member 72 with the lower margin held in engagement with the flange 72*c*. Thus, the board 57 is retained by the retaining member 72 against movement. For mounting the printed circuit board 57 on the upper shell 13, the board 57 is first arranged so that the rear legs 56 are received in the respective apertures 57*a*. Then, the board 57 is moved in a direction toward the front of the upper shell 13 until the front end of the board 57 is brought into engagement with the front legs 55 with the rear legs 56 engaging the respective apertures 57*a*, as described above. Then, the retaining member 72 is attached to the upper shell 13, as described above, to hold the board 57 against movement.

A plurality of switch contacts 71 are arranged on the upper surface of the printed circuit board 57 in registry with the central portions 70*a* of the respective conductive rubber strips 70, the central portions 70*a* being normally spaced from the respective switch contacts 71. Each pair of the conductive rubber 70 and the contact 73 constitutes a key switch. Alternatively, a single elongated conductive rubber may be provided common for all the switch contacts 73 if a known key operation scanning technique is employed.

Figure 5:
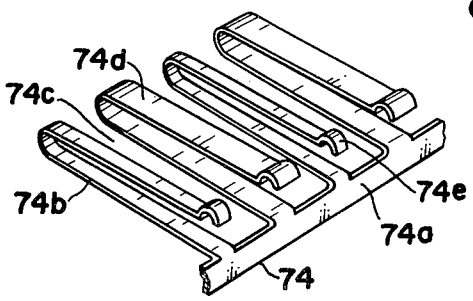
FIG. 5 is a resilient member employed in the keyboard structure.

As best shown in FIG. 5, a resilient member 74 of a unitary or one-piece construction has an elongated base 74*a* and a plurality of arms 74*b* extending at the right angles from the base 74*a*, the arms 74*b* being spaced along the length of base 74*a* by slits 74*c* formed therebetween. The resilient member 74 is made of spring metal. Each of the arms 74*b* is bent into a U-shaped configuration to provide a resilient portion 74*d*. The arm 74*b* has its free end formed into an arcuate convex shape to provide an engaging portion 74*e* for engagement with the key as will be described later. The resilient member 74 may be formed by stamping. The resilient arms support the white key and the black key by turns. The arm acting on each white key and the arm acting on each black key have predetermined widths respectively so that all the white and black keys have a uniform touch.

The resilient member 74 is mounted on the rear portion 25 of the recess bottom 21 with the bass 74*a* received in the channel section 58. Each engaging portion 74*e* of the resilient member 74 is held in contact with the underside of the top wall 63*c* and 64*b* of a respective one of the keys 63 and 64 to normally urge the same into its raised or inoperative position (FIGS. 1 and 2). The base 74*a* and the engaging portion 74*e* are disposed near the fulcrum ridge 62. Each key is pivotally movable about the fulcrum or ridge 62 between its inoperative and operative or depressed positions. In the inoperative position of each key, the second leg 66*b* and 68*a* of the retaining portion 66 and 68 is held against the left strip 35 to limit the upward movement of the spring-biased key. Upon depression of each white key 63 into its operative position, the lower edge of the front end wall 63*d* is brought into engagement with the felt strip 51 to limit the downward movement of the key. Similarly, upon depression of each black key 64 into its operative position, the lower edges of the arms 64*a* are brought into contact with the felt strip 34 to limit the downward movement of the key. Since the first and second guide webs 47 and 48 are disposed respectively between the arms of the white and black keys 63 and 64, they serve to guide the downward movement of the white and black keys to thereby prevent the lateral movement thereof. As shown in FIGS. 1 and 2, the rear end of each key is disposed in closely spaced, overlying relation to the first portion 72*a* of the L-shaped retaining member 72. This prevents the groove 63*f*, 64*c* of each key from becoming disengaged from the fulcrum ridge 62 during the operation of the key. Thus, the retaining member 72 serves not only to retain the printed circuit board 57 but also to prevent the disengagement of the key from the fulcrum 62.

As shown in FIG. 2, the main circuit board 75 is located under the key switch circuit board 57. The main circuit board 75 is a printed circuit board to carry a tone generation circuit, a tone coloring circuit, an automatic circuit and etc. including one or more large-scale integrated circuits and discrete electronic components. This main circuit board is also fixed to the upper shell 13 by means of abutting pillars 76 integrally formed on the interior of the shell 13 and screws 77 received by screw receiving bosses of the shell 13.

Upon depression of each key, the actuator portion 67 and 69 biases the central portion 70*a* of the conductive rubber 70 into contact with the switch contact 71 so that the tone generating circuit and other associated circuits fabricated on the main circuit board 75 are energized to electronically sound a selected note in a known manner through a load speaker 78 which is contained in the rear portion of the casing 12 and is fixed to the upper shell 13 by fixing screws (not shown).

The various sections for mounting the keys, the resilient member, the key switches and the printed circuit boards are formed integral with the upper shell of the casing and disposed in underlying relation to the juxtaposed keys. With this construction, the casing has a pleasing appearance. Also, the battery receiving portion defined by the channel portion is formed integral with the upper shell and disposed in underlying relation to the juxtaposed keys. With this arrangement, the casing has a reduced horizontal depth. Further, each key can be easily mounted on and removed from the casing because the convex section does not interfere with the retaining portion of the key during the mounting and removal of the key.

By virtue of the provision of the one-piece resilient member, the forces exerted on the respective keys are kept to the same level. This provides for a uniform and pleasant touch of the keys. In addition, since stress is distributed along the elongated base of the resilient member upon depression of the keys, the strength of the bottom wall of the recess is reduced to a minimum.

Further, since the L-shaped retaining portion of each single-molded key has the first leg and the second leg disposed in offset relation to the first leg, the molding machine for forming the key is simple in construction.

While the keyboard structure according to the invention, has been specifically shown and described herein, the invention itself is not to be restricted by the exact showing of the drawings of the description thereof. For example, although the second leg of the retaining portion of each key extends in parallel to the top wall of the key body, it may be inclined with respect to the top wall. Further, the channel section 58 may be replaced by an elongated projection, and the base of the resilient member may be channel-shaped so that the channel-shaped base can be fitted on the elongated projection to fix the resilient member relative to the upper shell of the casing.

What is claimed is:

1. A keyboard musical instrument which comprises:

(a) a casing comprising molded upper and lower shells coupled together to form the casing;

(a) a plurality of keys mounted on said upper shell in juxtaposed relation; and (c) means mounted on said upper shell for normally urging said keys into raised positions;

(d) said upper shell including fulcrum means formed integrally therewith which supports each key for pivotal movement thereabout between its raised and depressed positions, integral stop means for limiting the downward and upward movements of said keys, integral guide means for guiding the downward and upward movements of each key to prevent the lateral movement thereof, and integral mounting means for supporting a key switch structure, all of said stop means, said guide means and said mounting means being disposed in underlying relation to said juxtaposed keys.

2. An instrument according to claim 1, in which said upper shell has a battery receiving portion integrally formed with the upper shell and disposed in underlying relation to said juxtaposed keys and at a location more remote from said fulcrum means for the keys than said mounting means is.

3. An instrument according to claim 1, in which said upper shell has a recess at a top wall in which said keys are received in spaced relation to a bottom wall of said recess, said urging means acting between the recess bottom wall and each key, said stop means, said guide means and said mounting means being formed on the recess bottom wall, and said fulcrum means being in the form of a ridge formed on the underside of said top wall adjacent to a rear end of said recess, and each of said keys having on an upper surface a transverse groove in which said ridge is received.

4. An instrument according to claim 3, in which said recess bottom wall has a front portion, a rear portion disposed upwardly of a rear end of said front portion, and a connecting section interconnecting the rear end of said front portion and a front end of said rear portion, said front portion having a convex section, said upper shell having a pair of spaced apart plates depending from said front portion and extending generally parallel to a front face of said upper shell, said depending plates defining with said convex section a generally downwardly opening channel which serves as a battery receiving portion.

5. An instrument according to claim 4, in which said mounting portion comprises a pair of spaced apart ribs formed integrally on the underside of said rear portion of the recess bottom wall and extending generally parallel to the front face of said upper shell.

6. A key board structure according to claim 3, in which each of said keys comprises a body of a generally downwardly opening channel shape, said guide means comprising webs formed integrally on said recess bottom wall in registry with the respective channel-shaped keys so that each said web is introduced into the channel-shaped key upon depression of the key.

7. An instrument according to claim 4, in which each of said keys has a downwardly extending L-shaped retaining portion, said connecting section having openings extending between said front and rear portions of said recess bottom wall to receive the L-shaped retaining portions of the respective keys, said stop means comprising the front end of said rear portion of said recess bottom wall, said L-shaped retaining portion being engageable with the lower surface of said front end to limit the upward movement of each key, and each key being engageable with the upper surface of said front end to limit the downward movement thereof.

8. An instrument according to claim 4, in which said stop means comprising a stopper surface at the front portion disposed forwardly of said convex section for limiting the downward movement of each key, said key being engageable with said stop surface.

9. An instrument according to claim 1, in which said urging means comprises a resilient member of a unitary construction having an elongated base and a plurality of arms extending generally perpendicularly from said base and spaced along the length thereof, each of said arms being bent into a U-shaped configuration to provide a resilient portion, said resilient member being secured at said base to said upper shell and disposed in underlying relation to said juxtaposed keys, each of said resilient portions being held in contact at its free end with an underside of a respective one of said keys to normally urge the key into the raised position.

10. An instrument according to claim 1, in which each of said keys comprises an integrally molded elongated body having an L-shaped retaining portion having a first leg extending downwardly from said key body and a second leg which protrudes from said first leg in two directions perpendicular to each other, said second leg being engageable with said stop means for limiting the upward movement of the key, and said key body also having an actuator portion extending downwardly from the key body to actuate said key switch structure upon depression of said key.

11. An instrument according to claim 1, in which said mounting means of the upper shell comprises integral portions for supporting said key switch structure and a circuit board associated with the key switch structure, said integral supporting portions being disposed in underlying relation to said juxtaposed keys.

12. An instrument according to claim 11, further comprising an L-shaped retaining member having a first portion disposed generally parallel to said keys and a second portion extending downwardly from said first portion, said second portion of said retaining member engaging said circuit board to retain the board against movement in cooperation with said integral supporting portion, and said first portion of said retaining member being disposed in closely spaced underlying relation to the rear end of each key to prevent said key from becoming disengaged from said fulcrum means during an operation of the key.

* * * * *